US006699140B1

(12) United States Patent
Sun

(10) Patent No.: US 6,699,140 B1
(45) Date of Patent: Mar. 2, 2004

(54) GOLF PUTTER HEAD WITH HONEYCOMB FACE PLATE STRUCTURE

(76) Inventor: Donald J. C. Sun, 9048 Ardendale Ave., San Gabriel, CA (US) 91775

( * ) Notice: Subject to any disclaimer, the term of this patent is extended or adjusted under 35 U.S.C. 154(b) by 0 days.

(21) Appl. No.: 10/174,758

(22) Filed: Jun. 18, 2002

(51) Int. Cl.[7] ..... A63B 53/04

(52) U.S. Cl. ..... 473/252; 473/341; 473/342; 473/332

(58) Field of Search ..... 473/324, 340, 473/341, 349, 329, 332, 347, 330, 331, 252, 342

(56) References Cited

U.S. PATENT DOCUMENTS

| | | | | | |
|---|---|---|---|---|---|
| 3,847,399 | A | | 11/1974 | Raymont | |
| 4,444,395 | A | | 4/1984 | Reiss | |
| 4,664,383 | A | | 5/1987 | Aizawa | |
| 4,679,792 | A | * | 7/1987 | Straza et al. | 473/329 |
| 4,681,322 | A | * | 7/1987 | Straza et al. | 473/329 |
| 4,930,781 | A | * | 6/1990 | Allen | 473/346 |
| 5,060,951 | A | | 10/1991 | Allen | |
| 5,301,941 | A | | 4/1994 | Allen | |
| 5,308,067 | A | | 5/1994 | Cook | |
| 5,401,021 | A | | 3/1995 | Allen | |
| D359,783 | S | | 6/1995 | Allen | |
| 5,497,993 | A | | 3/1996 | Shan | |
| D385,609 | S | | 10/1997 | Cameron | |
| 5,735,755 | A | | 4/1998 | Kobayashi | |
| 5,924,939 | A | * | 7/1999 | Grace et al. | 473/324 |
| 5,944,619 | A | * | 8/1999 | Cameron | 473/332 |
| D431,622 | S | | 10/2000 | Sato | |
| 6,200,229 | B1 | * | 3/2001 | Grace et al. | 473/324 |
| 6,231,458 | B1 | * | 5/2001 | Cameron et al. | 473/332 |
| 6,319,150 | B1 | | 11/2001 | Werner et al. | |
| 6,334,818 | B1 | * | 1/2002 | Cameron et al. | 473/332 |
| 6,450,894 | B1 | * | 9/2002 | Sun et al. | 473/252 |

* cited by examiner

*Primary Examiner*—Sebastiano Passaniti
(74) *Attorney, Agent, or Firm*—Edward A. Sokolski

(57) ABSTRACT

A golf putter head has a central indented concave face portion in which a face plate is either directly formed or installed after it is formed. The face plate has a honeycomb structure with three layers formed from a soft polymer material. The outer or top layer has a honeycomb corrugated construction with equally spaced cells and fits into the cavity of the central portion. The second layer which is similar in configuration to the top layer is immediately beneath the outer layer in abutment there against. The third layer which abuts against the surface of the concave face plate is in the form of a plurality of pins which extend through the cells of the other two layers. Toe and heel portions are removably attached to the opposite sides of the head face portion by means of aligning pins and threaded bolts.

5 Claims, 3 Drawing Sheets

GOLF PUTTER HEAD WITH HONEYCOMB FACE PLATE STRUCTURE

BACKGROUND OF THE INVENTION

1. Field of the Invention

This invention relates to golf club putters and more particularly to such a putter having a honeycomb face plate fabricated of a polymer.

2. Description of the Related Art

It has been found that the performance of golf clubs can be improved if the face portion is made light and the toe and heel portions are weighted. One way of achieving this end result is to make the structure of the face plate in the form of a honeycomb with a thin substantially flat layer over the honeycomb structure. Such prior art devices are found in patent U.S. Pat. No. 3,847,399 issued on Nov. 12, 1974 to Raymont; U.S. Pat. No. 5,735,755 issued Apr. 7, 1998 to Kobayashi and U.S. Pat. No. 5,060,951 issued Oct. 29, 1991 to Allen. To reinforce the structure of the face plate without adding very much weight, certain prior art devices add plastic which is inserted in the cells of the honecomb structure. Such devices are described in U.S. Pat. No. 5,497,991 issued Mar. 12, 1996 to Shan; U.S. Pat. No. 4,664,383 issued May 12, 1987 to Aizawa; and U.S. Pat. No. 5,301,941 issued Apr. 12, 1994 to Allen.

My prior application Ser. No. 09/649,750 filed Aug. 8, 2000 describes the advantages of employing toe and heel portions which are weighted and to maximize the anti-twist moment of inertia of the club to make for more accurate putting. An advantage of the device of my prior application is that the toe and heel portions while firmly attached can readily be removed and replaced with elements of different weights. Patents with removable toe and heel weights are also described in U.S. Pat. No. 4,444,395 issued Apr. 24, 1984 to Reiss and U.S. Pat. No. 5,308,067 issued May 3, 1994 to Cook.

SUMMARY OF THE INVENTION

The device of the present invention has a central portion made of a lightweight metal alloy such as an extruded aluminum or thin S.S. castings. To further lighten the central portion, a cavity is formed in the rear part thereof. The central portion also has a cavity formed in the front part thereof. The face plate is either directly formed in the front cavity or installed therein after it is formed. The face plate has a honeycomb structure with three layers which are formed from a soft polymer material. The outer or top layer has a honeycomb corrugated structure with equally spaced cells, this layer fitting tightly into the cavity portion formed in the front of the central portion. The second layer which is similar in structure to the outer layer is immediately beneath the outer layer in abutment there against. The third layer which abuts against the surface of the recessed portion of the face of the head is in the form of a plurality of pins which fit into and extend through the cells of the two other layers.

The layered structure of the face plate can be formed directly in the front cavity in the central portion of the head. This can be done by first forming the top and second layers and then installing the two layers in the front cavity. Polymer material is then poured through the cells of the honeycomb structure forming pins which are attached to the surface of the front cavity and extend through the honeycomb cells.

In the alternative, the face plate can be formed separately and in its finished form installed in the front cavity.

Weighted toe and heel portions are attached to the opposite sides of the central head portion for ready removal and reinstallation as may be desired. Such attachment is made by means of aligning pins and threaded bolts.

It is therefore an object of this invention to make for an improved putter having a lightweight yet sturdy face plate.

It is a further object of this invention to provide an improved putter head having a light weight and a desired hardness of its face plate in a honeycomb structure along with readily removable toe and heel portions.

Other objects of the invention will become apparent as the description proceeds in connection with the accompanying drawings.

DETAILED DESCRIPTION OF THE INVENTION

Figure 1:
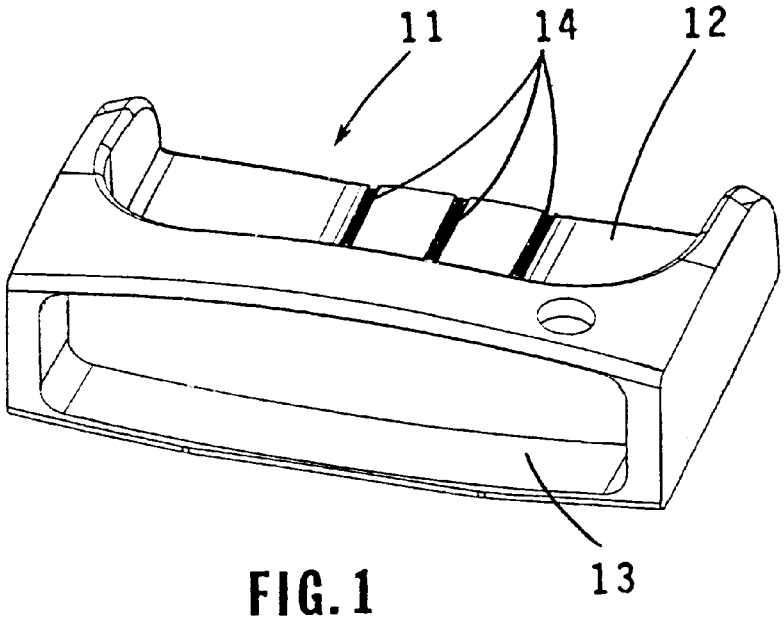
FIG. 1 is a front top perspective view of the face portion of a preferred embodiment of the invention.
Figure 2:
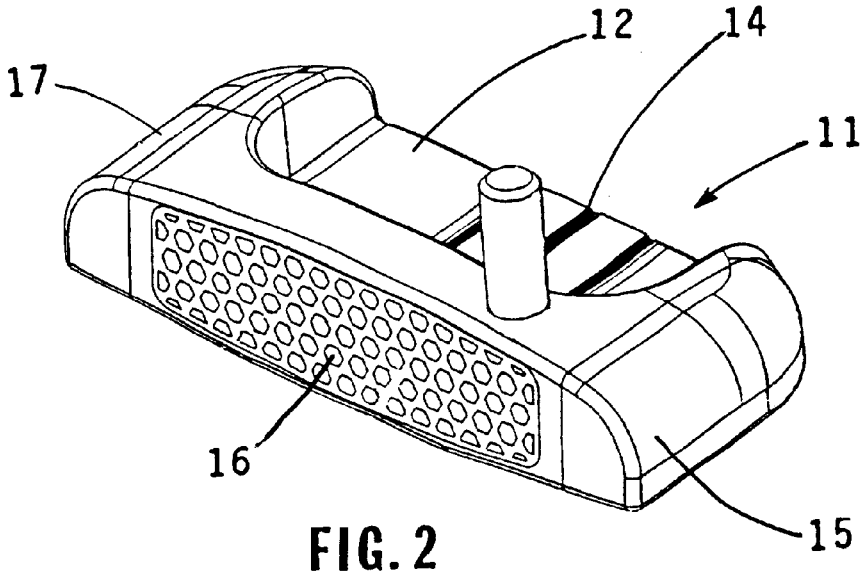
FIG. 2 is a top front perspective view of the preferred embodiment with the face plate installed.
Figure 3:
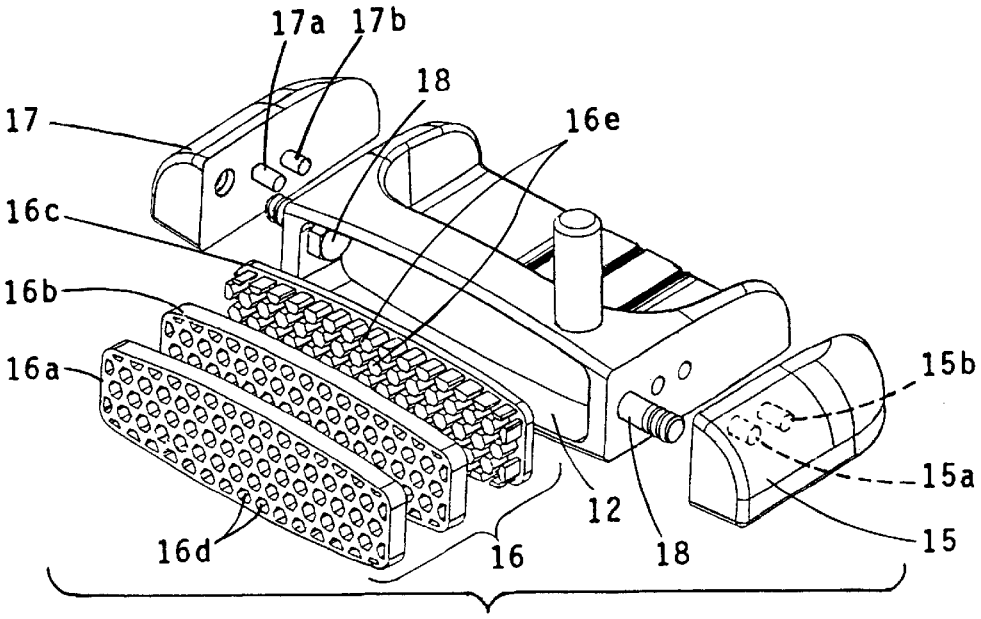
FIG. 3 is a top front exploded view of the preferred embodiment.
Figure 4:
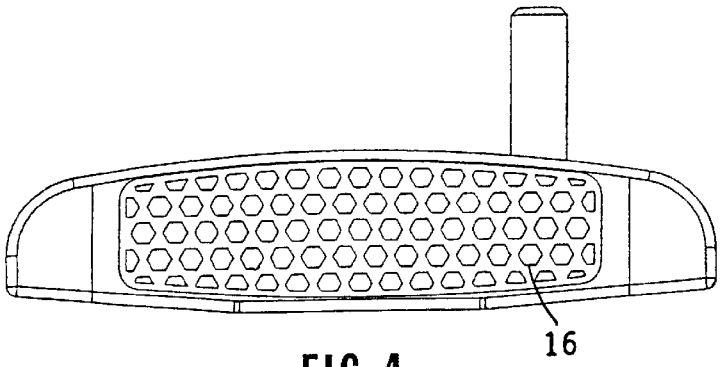
FIG. 4 is a front elevational view of the preferred embodiment.
Figure 5:
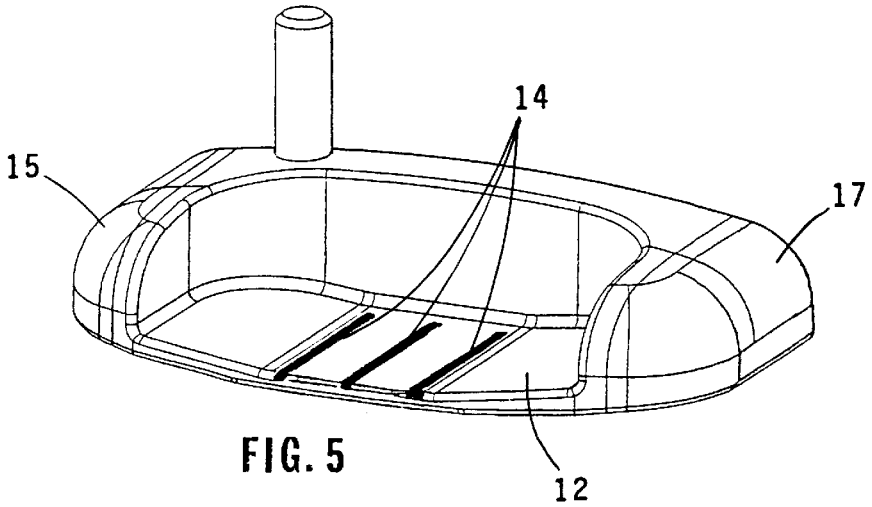
FIG. 5 is a rear perspective view of the preferred embodiment.

Referring now to FIGS. 1–5, a preferred embodiment of the invention is illustrated. The central portion 11 of the golf club head has a cavity 12 formed in the rear and a cavity 13 formed in the front. Siting markers 14 are formed in the bottom wall of cavity 12. Honeycomb face plate structure 16, which is fabricated of a suitable polymer, is installed in cavity 12. The outer and central honeycomb sections 16*a* and 16*b*, as best can be seen in FIG. 3, are prefabricated and are identical. In installing the honeycomb face plate, the layers 16*a* and 16*b* are tightly inserted in the cavity 12, and liquid polymer material poured through the cores formed therein so that they pass there through to the inner wall of the cavity 12. The structure of layer 16*c* is thus formed with pins 16*e* protruding through the core holes 16*d*. When the polymer hardens, this makes for a reinforced honeycomb core structure of light weight.

Heel and toe portions of the head 15 and 17 are removably attached to the central portion of the head so that they can readily be removed and replaced, as may be desired. As can be seen in FIG. 3, the heel and toe portions are aligned in position by means of pins 15*a*, 15*b*, 17*a* and 17*b* respectively. The toe and heel portions are then held tightly in position by means of bolts 18 which threadably engage the toe and heel portions.

Figure 6:
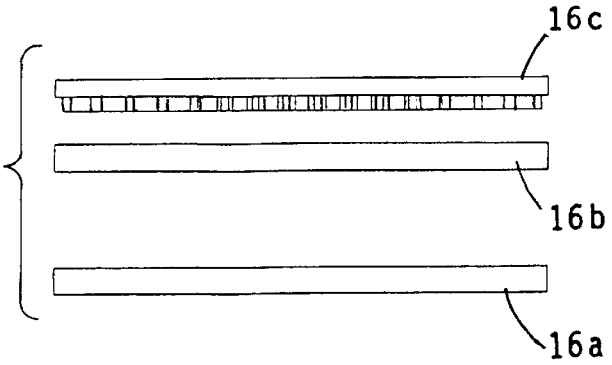
FIG. 6 is an exploded view illustrating an alternative method for constructing the preferred embodiment.
Figure 7:
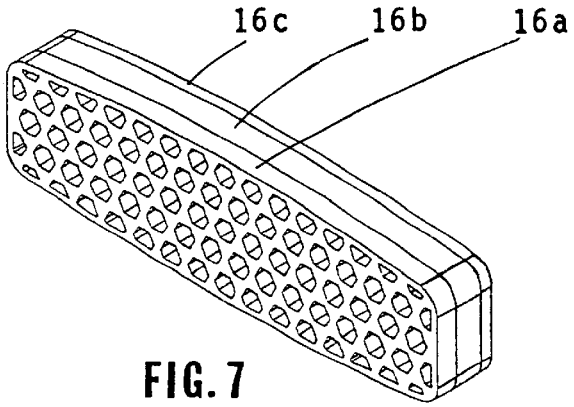
FIG. 7 is a top perspective view illustrating the alternative method for constructing the preferred embodiment.

A second method for fabricating the device is illustrated in FIGS. 6 and 7. In this embodiment, the three layers are all prefabricated and then assembled to make for a single unit which is then cemented into the cavity.

It is to be noted that while in the preferred embodiment, three layers are shown, it would be possible to utilize more honeycomb layers than two along with a single layer having pins, or only a single honeycomb layer.

While the invention has been described in detail, it is to be understood that this is intended by way of illustration and example only, the scope of the invention being limited by the terms of the following claims.

I claim:

1. A golf putter head comprising:

a central portion with a first cavity formed in the front part thereof and a second cavity formed in the rear part thereof;

a face plate formed from top and central layers, each having a similar honeycomb structure with equally spaced cells and a third bottom layer having a plurality of pins extending therefrom into the cells of said top and central layers;

said face plate being installed in the first cavity of said central portion;

a toe portion removably attached to one side of said central portion; and a heel portion removably attached to the side of said central portion opposite said one side thereof.

2. The golf putter head of claim 1 and further including aiming markers formed on the wall of said second cavity.

3. The golf putter head of claim 1 wherein said face plate is fabricated of a polymer material.

4. A golf putter head comprising:

a central portion with a cavity formed in the front thereof; and a face plate installed in the cavity of said central portion, said face plate being formed from an upper layer having a honeycomb structure with spaced cores formed therein, said upper layer being formed from two similar honeycomb layers which are joined together to form a unitary assembly and a lower layer attached to the wall of said cavity and having a plurality of pins extending upwardly from the surface of said wall through the cores of said honeycomb.

5. A golf putter head comprising:

a central portion with a cavity formed in the front thereof;

a face plate installed in the cavity of said central portion, said face plate being formed from an upper layer having a honeycomb structure with spaced cores formed therein and a lower layer attached to the wall of said cavity and having a plurality of pins extending upwardly from the surface of said wall through the cores of said honeycomb;

a toe portion removably attached to one end of said central portion; and a heel portion removably attached to the end of said central portion opposite to said one end thereof.

* * * * *